US005268660A

United States Patent [19]

Cappelli

[11] Patent Number: 5,268,660

[45] Date of Patent: Dec. 7, 1993

[54] QUADRANT DRIVER FOR MICROWAVE SWITCHES

[76] Inventor: Guido G. Cappelli, 46 Browing Dr., Dollard des Ormeaux, Québec, Canada, H9G 2K4

[21] Appl. No.: 925,748

[22] Filed: Aug. 7, 1992

Related U.S. Application Data

[63] Continuation-in-part of Ser. No. 529,597, May 29, 1990, abandoned.

[51] Int. Cl.[5] ..... H01H 53/00

[52] U.S. Cl. ..... 335/4; 333/104

[58] Field of Search ..... 333/103-106; 335/4, 5, 104, 105

[56] References Cited

U.S. PATENT DOCUMENTS

| | | | |
|---|---|---|---|
| 4,370,631 | 1/1983 | Gerber et al. | 333/106 |
| 4,447,793 | 5/1984 | Gray | 333/106 |
| 4,520,331 | 5/1985 | Steidel | 335/125 |
| 4,804,934 | 2/1989 | Finke et al. | 335/229 |

*Primary Examiner*—Lincoln Donovan
*Attorney, Agent, or Firm*—ROBIC

[57] ABSTRACT

A quadrant driver is disclosed, for use to drive the rotor of a microwave switch at 90° from one given input-output configuration to another given input-output configuration and vice verse. The driver comprises a magnet and bearing holder rotatably mounted inside a housing. The holder supports, on one side, a thin, high magnetic density magnet and, on the other side, a bearing operatively connected to the rotor of the microwave switch to rotate this rotor when the holder is itself rotated, the holder and magnet being rotated between two rest positions, each of the rest positions corresponding to one of the two configurations of the microwave switch. A pair of coils are mounted concentric to mild steel cores mounted within the housing so that one of the cores faces with a given offset the magnet when the magnet is in one of its rest positions and the other core faces with a given offset the magnet when this magnet is in the other of its rest positions. A power source is used to selectively energize each of the coils to cause rotation of the magnet and associated holder from one of its rest position to the other, and vice versa, whenever desired. The advantages of using the quadrant driver are: size reduction, weight reduction, production cost reduction, maintenance cost reduction, easily adjustable to different driving voltages.

9 Claims, 4 Drawing Sheets

QUADRANT DRIVER FOR MICROWAVE SWITCHES

This application is a continuation-in-part of application Ser. No. 07/529,597 filed on May 29, 1990 now abandoned.

BACKGROUND OF THE INVENTION

1. Field of the Invention

The present invention relates to a new electrical device, hereinafter called "quadrant driver", for use to rotate and thus acuate a microwave switch.

2. Brief Description of the Prior Art

Microwave switches have been in use for some decades in the telecommunication industry. Their purpose is to direct microwave signals from one initial input-/output configuration into a final input/output configuration. Switching from one configuration to the other and vice versa is achieved by driving a rotor forming part of the switch from one position to another position at 90° from the first one and vice versa.

In an electrically driven microwave switch, the movement of the switching rotor is traditionally obtained by the use of an external DC or stepper motor. Standard bearing and groove Geneva linkage is often used to couple the motor to the switching rotor. The advantage of the Geneva linkage is that it eliminates unwanted bounces of the switching rotor at the end of each rotation.

The external DC or stepper motors and associated mechanisms that are presently being used to drive the rotors of microwave switches are quite efficient. However, they are big in size and require maintenance.

SUMMARY OF THE INVENTION

An object of the present invention is to provide a new electrical device, or "quadrant driver", for driving the switching rotor of a microwave switch, which device advantageously replaces the DC or stepper motors that have been used so far.

The quadrant driver according to the invention is intended to be used for driving the rotor of a microwave switch at 90° from one given input-output configuration to another given input-output configuration and vice versa. This quadrant driver basically comprises:

- a housing;
- a magnet and bearing holder rotatably mounted inside said housing, said holder supporting, on one side, a thin, high magnetic density magnet and, on the other side, a bearing operatively connected to the rotor of the microwave switch to rotate the same when said holder is itself rotated, said holder and magnet being rotated between two rest positions, each of said rest positions corresponding to one of the two configurations of the microwave switch;
- a pair of coils concentric to mild steel cores, said cores being mounted within the housing so that one of the cores faces with a given offset the magnet when this magnet is in one of its rest positions and the other core faces with a given offset the magnet when said magnet is in the other of its rest positions, said cores permanently spaced apart from the magnet; and
- means to selectively energize each of the coils to cause rotation of the magnet and associated holder from one of its rest position to the other, and vice versa, whenever desired.

An other object of the present invention is to provide a new electrical driven, microwave switch incorporating the quadrant driver as defined hereinabove as electrical means to drive it.

The quadrant driver according to the invention has the following advantages as compared to the existing DC or stepper motors:

- it is smaller in size (size reduction)
- it is lighter (weight reduction)
- it is less expensive to produce (production cost reduction)
- it is less expensive to maintain (maintenance cost reduction) and
- it is easy to adjust to any driving voltage.

A detailed description of the invention will now be given with reference to the accompanying drawings.

DETAILED DESCRIPTION OF THE INVENTION

Figure 1A:
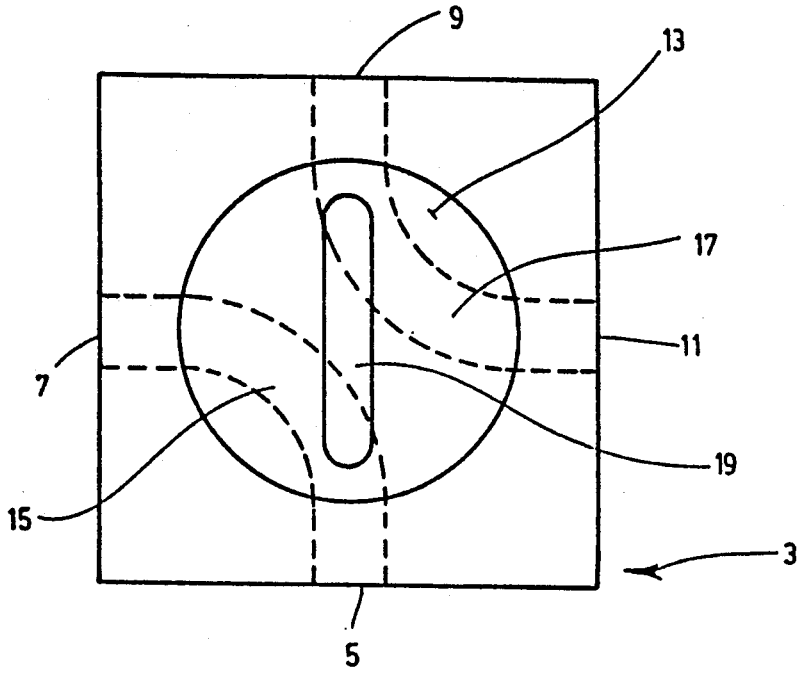
FIGS. 1*a* and 1*b* are top plan views of a microwave switch body without any motor or quadrant driver, showing the switching rotor in its two opposite positions.
Figure 1B:
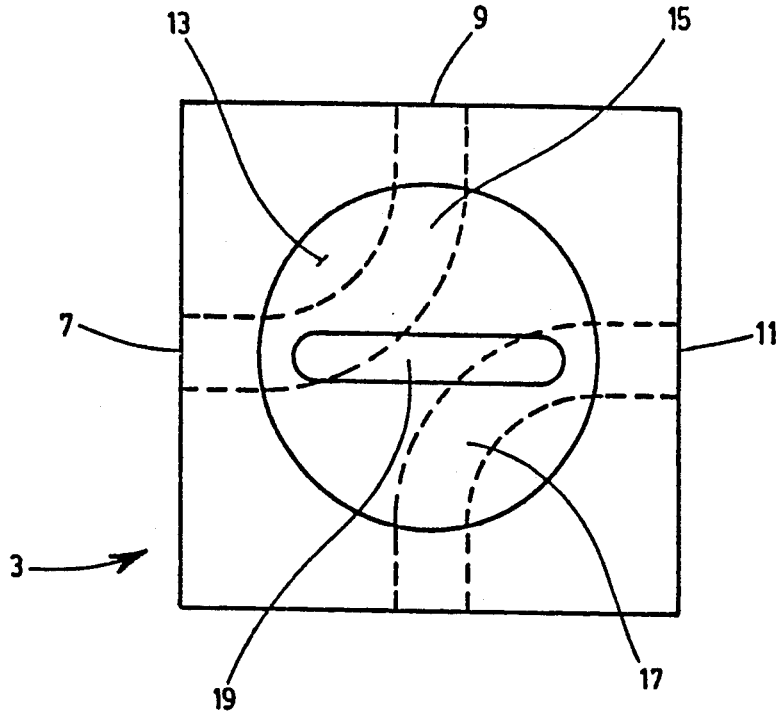
Figure 2:
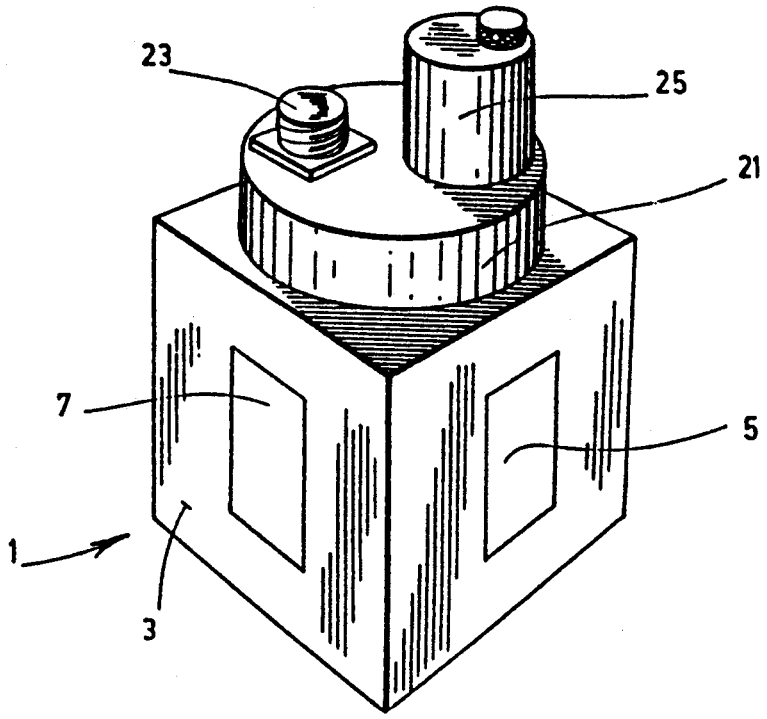
FIG. 2 (PRIOR ART)
FIG. 2 is a perspective view of an existing microwave switch, provided with a conventional driving box and external motor.
Figure 3:
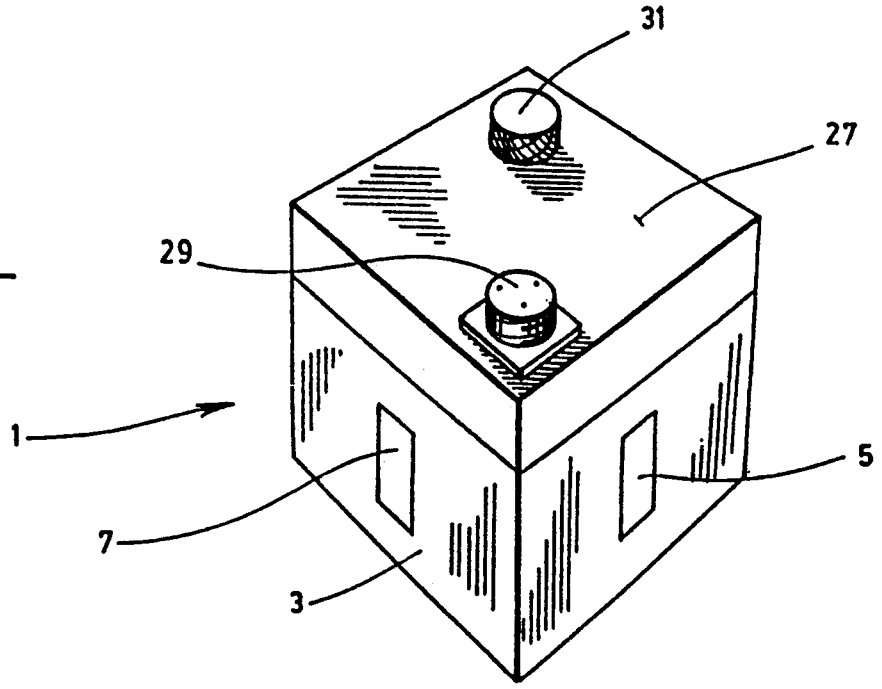
FIG. 3 is a perspective view of a microwave switch provided with a quadrant driver according to the invention.

FIGS. 1 to 3 shows a microwave switch 1 of conventional structure, comprising a cubic body 3 having ports 5,7,9,11 in its lateral faces A switching rotor 13 is rotatably mounted in the body 3. As better shown in FIGS. 1*a* and 1*b*, the rotor 13 has a pair of opposite, 90° oriented passages 15,17 which, depending on the position of the rotor, connect part 5 to part 7 and part 9 to part 11 (first position shown in FIG. 1*a*) or part 5 to part 11 and part 7 to part 9 (second position shown in FIG. 1*b*), respectively.

Up to now, rotation of the rotor 13 from its first to second position and vice-versa has been achieved with a driving mechanism as shown in FIG. 2, comprising a driving box 21 including a power connector 23 and a Geneva linkage (not shown) operatively connected at one end to a groove 19 provided on top of the rotor (see FIGS. 1*a* and 1*b*) and, at the other end, to a DC or stepper motor 25.

In accordance with the invention, the same rotation in achieved with a quadrant driver 27 as shown in FIG. 3, which is much compact in size, very simple in structure and very efficient in use, the driver 27 including on its top surface a power connector 29 and a knob 31 for manual override.

Figure 4A:
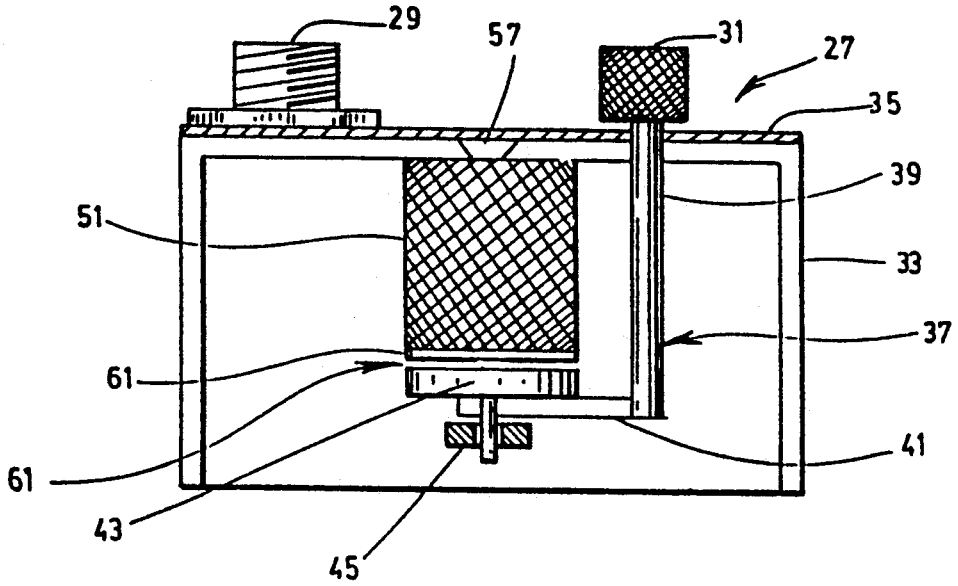
FIG. 4*a* and 4*b* are cross-sectional, side elevational and bottom plan views of the quadrant driver shown in FIG. 3, in one of its two positions.
Figure 4B:
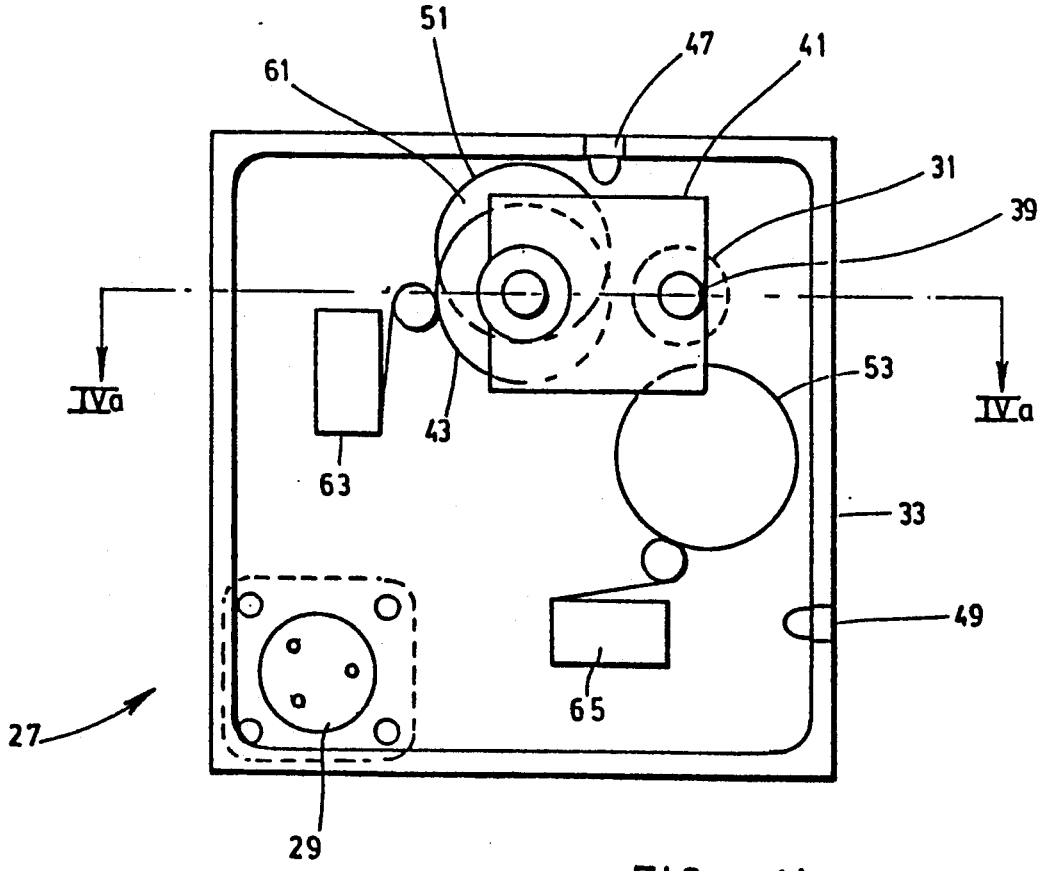
Figure 5:
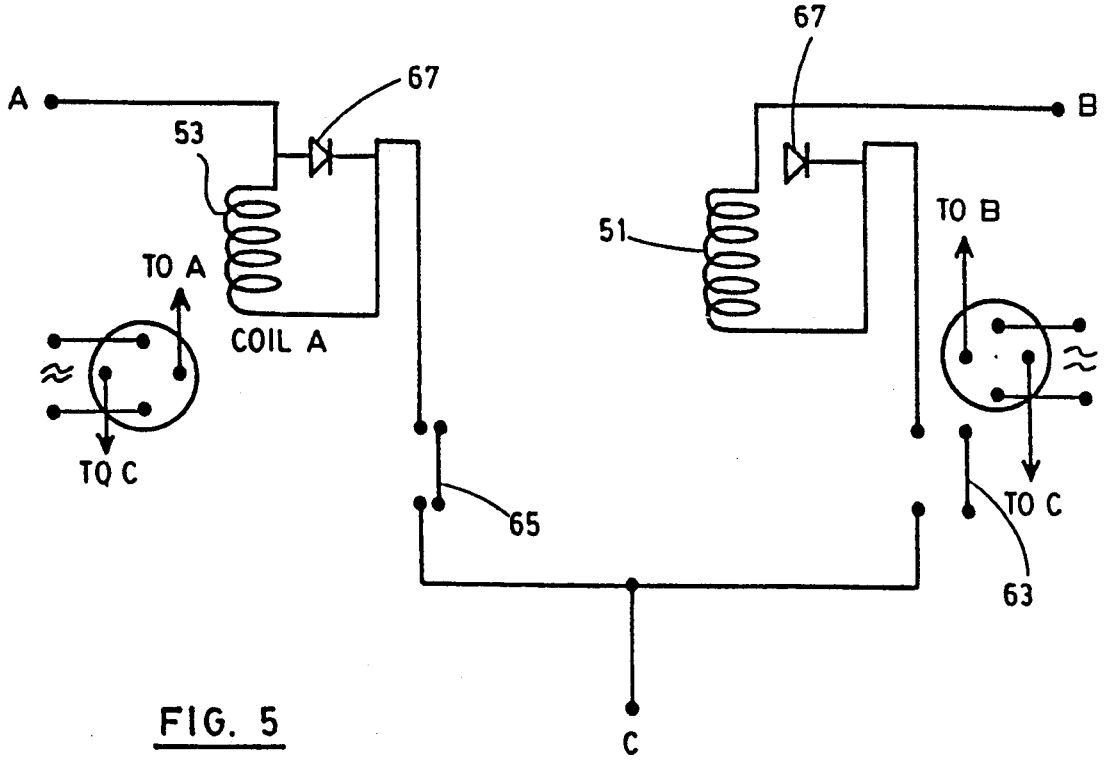
FIG. 5 is a schematic representation of the quadrant driver electrical circuit.
Figure 6:
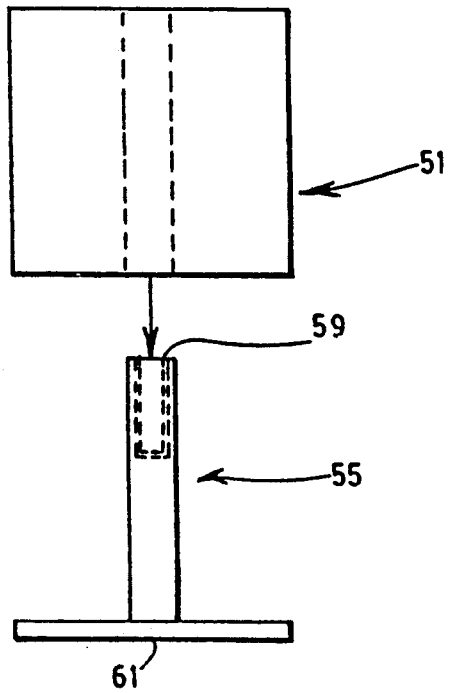
FIG. 6 is an exploded view of a single coil and mild steel core used in the quadrant driver according to the invention.

Referring now to FIGS. 4 to 6, the quadrant driver 27 according to the invention, basically comprises quadrant driver housing 33. This driver housing which is preferably made of metal such as aluminum, provides support to the driving mechanism disclosed hereinafter. It is mounted on the switch body 3 by means of mounting screws (not shown). The housing 33 includes a mild steel plate 35 acting as magnetic shield on its outside top part (see FIG. 4*a*) in order to curve downwards the magnetic lines generated by the coils located inside the housing as will be described hereinafter.

The housing 33 also includes a Geneva arm assembly 37 comprising a rotatable stainless steel shaft 39 and a magnet and bearing holder 41 attached to the shaft 39. A high density magnet 43 is secured to one side of the holder 41 and a ball bearing 45 is secured to the other side. The ball bearing that is preferably very small, provides the link to the rotor 13 of the microwave switch 1. The knob 31 for manual override is attached to the shaft 39 on the outside of the quadrant driver housing 33.

The magnet and bearing holder 41 can rotate about the axis of the shaft 39 between two positions at 90° from each other, as shown with the arrow in FIG. 4*a*. The housing 33 includes two adjustable mechanical stops 47, 49 fixed to the housing walls at 90° to each other, in order to stop the magnet and bearing holder 41 in the proper position at the end of each travel.

The housing also includes the power connector 29 to bring power to a pair of coils 51,53.

The coils 51,53 are made of a wire of the proper size. Typically the coils are formed out of a few thousands loops of wire. The size of the wire and the number of loops depend on the driving voltage requirements and on the size of the quadrant driver itself. Each coil is mounted concentric to a mild steel core 55 (see FIG. 6). Each mild steel core 55 is secured to the quadrant driver housing 33 usually by screws 57 inserted into a threaded hole 59 provided for this purpose on top of the core 55 so that the broad side of the core 61 faces with a given offset the high density magnet 43 (see FIG. 4) which can be made of samarium cobalt or equivalent, in the form of a thin disk or slab.

At least two miniature lever switches 63, 65 (see FIG. 4*b*) at 90° to each other, are secured to the quadrant driver housing, close to the coils 51,53, respectively. The function of these two switches is to cut the power from the energizing coils 51,53 at the end of the travel of the magnet and bearing holder 41. They are mechanically activated by the magnet and bearing holder assembly when this assembly is near the end of each of its back and fro 90° rotations. More than one miniature lever switch can be activated at the same time at the end of each travel, to indicate, by way of example, the final position of the rotor.

Connecting wires are provided, as well as spark suppression diodes 67 and AC to DC transformers as is shown in FIG. 5, to interconnect the above mentioned elements. The spark suppression diodes 67 across the coils are recommended when DC power is used to energize the coils. AC to DC transformers are necessary when only AC power is available.

The quadrant driver 27 disclosed hereinabove operates as follows to drive the rotor of the microwave switch 1.

When both coils are de-energized, the attraction between the magnet 43 and the mild stell core 61 of the corresponding coil keeps the magnet 43 and bearing holder 41 in a first initial position. In this position, the device is magnetically latched If the ball bearing 45 is engaged in the groove 19 of the microwave switch rotor 13 (FIG. 1), the rotor will be kept in that position If, say, coil 53 is now energized with a DC current of such direction to create a magnetic field of the same polarity as the magnet 43 facing the coil 53, there will be a repulsion between the magnet 43 and the coil 53. As the coil and the magnet are slightly offset (see FIG. 4), the magnet 43 and magnet holder 41 will move in a radial motion away from coil 53 towards coil 51, the center of this rotation being the axis of rotation of the shaft 39. If a high magnetic density magnet 43 (samarium cobalt or equivalent) is used together with an appropriate current in the coil, the repulsion is sufficient to quickly drive the rotor 13 of the microwave switch 1 linked to the magent 43 and bearing holder 41 by the ball bearing 45 groove 19 combination. As the magnet 43 approaches the other coil 51, the repulsion from coil 53 decreases but the magnetic attraction from the mild steel core 51 increases. It must be noticed that the magnet and magnetic cores are never in contact as a small air gap 69 is left between the two (FIG. 4*a*). Near the end of the rotation, the miniature switch 65 will open, interrupting the current to the coil 53. The magnetic attraction between the coil 51 and the magnet 43 will pull the magnet and bearing holder 41 in its final position, 90° away from its initial position. At this point, the microwave switch rotor 13 will be rotated 90 degrees from its initial position. Also at this point, the quadrant driver is ready for a new operation that starts by energizing coil 51.

The Geneva linkage is important in this arrangement to prevent the rotor 13 from bouncing back as it would otherwise suffer due to its suddent stop in its final position. This bounce back is an undesirable feature in microwave switches.

The embodiments of the invention in which an exclusive property or privilege is claimed are defined as follows:

1. A quadrant drive for use to drive a rotor of a microwave switch at 90° from a first given input-output configuration to a second given input-output configuration and vice versa, said driver comprising:

a housing;

a magnet and bearing holder rotatably mounted inside said housing, said holder supporting, on one side, a thin, high magnetic density magnet of a given polarity and, on the other side, a bearing operatively connected to the rotor of the microwave switch to rotate said rotor when said holder is itself rotated, said holder and magnet being rotated between two rest positions, each of said rest positions corresponding to one of said first and second given input-output configurations of the microwave switch;

a pair of coils concentric to mild steel cores, said cores being mounted within the housing so that one of said cores faces with a given offset the magnet when said magnet is in one of its rest positions, said cores being permanently spaced apart from said magnet; and means to selectively energize each of the coils with a DC current of such a direction as to create a magnetic field having a polarity identical to the one of the magnet, said energization causing a direct magnetic repulsion between one coil at the time and the magnet and thus causing rotation of said magnet and associated holder from one of its rest positions to the other, and vice versa, whenever desired.

2. The quadrant driver of claim 1, wherein the magnet and bearing holder is secured to a stainless steel shaft rotatably mounted within the housing so as to rotatable with respect to the coils.

3. The quadrant driver of claim 2, further comprising a manual override rigidly secured to the stainless steel shaft.

4. The quadrant driver of claim 3, wherein the housing is made of metal and rigidly supports the coils and mild steel cores.

5. The quadrant driver of claim 3, further comprises two adjustable machanical stops at 90° to each other, said stops being rigidly secured to the housing and positioned to stop the magnet and bearing holder into each of its rest positions.

6. The quadrant driver of claim 5, further comprising a power connector rigidly secured to the housing.

7. The quadrant driver of claim 6, wherein said energizing means includes two miniature lever switches rigidly mounted at 90° to each other within the housing.

8. The quadrant driver of claim 7, wherein the energizing means further includes connecting wires to connect the coils to a power source through the miniature switches of and the power connector.

9. The quadrant driver of claim 8, wherein the energizing means further includes two AC to DC transformers to energize the coils with DC current.

* * * * *